US011003115B2

(12) United States Patent
Itoh et al.

(10) Patent No.: US 11,003,115 B2
(45) Date of Patent: May 11, 2021

(54) FIXING DEVICE AND IMAGE FORMING APPARATUS

(71) Applicant: FUJI XEROX CO., LTD., Tokyo (JP)

(72) Inventors: Kazuyoshi Itoh, Kanagawa (JP); Tomohiro Tarumi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/852,524

(22) Filed: Apr. 19, 2020

(65) Prior Publication Data

US 2021/0109467 A1 Apr. 15, 2021

(30) Foreign Application Priority Data

Oct. 11, 2019 (JP) ..... JP2019-187303

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 7,970,309 | B2 | 6/2011 | Sato et al. | |
| 9,128,430 | B2 | 9/2015 | Kawakami et al. | |
| 10,067,457 | B2 | 9/2018 | Fujiwara et al. | |
| 2013/0209130 | A1* | 8/2013 | Fukuzawa | G03G 15/205 399/70 |
| 2016/0327898 | A1* | 11/2016 | Fujiwara | G03G 15/2039 |

FOREIGN PATENT DOCUMENTS

| | | |
|---|---|---|
| JP | 2010237283 | 10/2010 |
| JP | 2013222097 | 10/2013 |
| JP | 2016212256 | 12/2016 |

* cited by examiner

*Primary Examiner* — Victor Verbitsky
(74) *Attorney, Agent, or Firm* — JCIPRNET

(57) ABSTRACT

A fixing device includes a fixing member, a heating element, a power supply circuit, and a processor. The fixing member is used in fixing on recording material. The heating element is used to heat the fixing member. The power supply circuit causes current in phase control to flow to the heating element. The processor is configured to set the phase of the current by using a combination of multiple phase control periods having different numbers of cycles supplied from an alternating-current power supply. The current flows to the heating element.

8 Claims, 11 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2019-187303 filed Oct. 11, 2019.

BACKGROUND

(i) Technical Field

The present disclosure relates to a fixing device and an image forming apparatus.

(ii) Related Art

Japanese Unexamined Patent Application Publication No. 2010-237283 describes an image forming apparatus including an image forming unit that forms a toner image on a recording sheet, a fixing device that heats the toner image to fix the toner image on the recording sheet, and a power supply device that supplies the fixing device with power from an alternating-current power supply. The image forming apparatus includes a power controller and a switching unit. Multiple continuous half waves from the alternating-current power supply are used as one control period to perform phase control on some of the continuous half waves. Wave number control is performed on the remaining half waves. The phase angle of the phase control in each half wave in the control period is made different, and the wave number of the wave number control is made different. Thus, the power controller controls power supplied to the fixing device. There are two or more types of control periods, and the switching unit switches between the control periods in image formation.

Japanese Unexamined Patent Application Publication No. 2013-222097 describes an image forming apparatus including a fixing unit and a power controller. The fixing unit has a heater that produces heat by using power supplied from an alternating-current power supply, and thermally fixes, on a recording sheet, an unfixed toner image formed on the recording sheet. The power controller controls power, which is supplied to the heater, so that the fixing unit is maintained at a target temperature. A given number of continuous half waves of the alternating-current waveform flowing through the heater are used as one control period. The power controller controls power, which is supplied to the heater, at a power ratio for each control period. The power ratio is determined in accordance with the temperature of the fixing unit from a control table. The control table stores multiple power ratios. The alternating-current waveform which flows through the heater in the control period includes a phase control wave form and a wave number control waveform. Multiple target temperatures are set. As the control table, multiple control tables including different ratios of the phase control waveform to the wave number control waveform in the control period are set. The power controller selects one of the control tables in accordance with a target temperature which is set, and selects the power ratio from the selected control table in accordance with the temperature of the fixing unit.

Japanese Unexamined Patent Application Publication No. 2016-212256 describes a fixing device having a first heating element through which an alternating current flows, a second heating element through which an alternating current flows, and a controller which controls a first switching device and a second switching device in the following manner. Both the waveforms of the alternating currents flowing through the first heating element and the second heating element have a first period and a second period which occur alternately in a control period. The first period is a period in which both of a phase control waveform and a wave number control waveform appear. The phase control waveform is such that a current flows at a point of a half cycle of an alternating current. The wave number control waveform is such that a current flows or does not flow over the entirety of a half cycle of an alternating current. The second period is a period in which only the wave number control waveform appears. When the first heating element is in the first period, the second heating element is in the second period. When the first heating element is in the second period, the second heating element is in the first period. Both the waveform of the alternating current flowing through the first heating element and the waveform of the alternating current flowing through the second heating element form a waveform having positive and negative symmetry electrically in a control period.

A fixing device having a low heat capacity is excellent in thermal responsiveness. Thus, temperature control through switching on/off a current produces large temperature ripples, causing the quality of a fixed image to be easily influenced. If phase control producing small temperature ripples is used, harmonic wave noise exceeding a defined reference may occur.

SUMMARY

Aspects of non-limiting embodiments of the present disclosure relate to a fixing device which suppresses harmonic wave noise so that the defined reference is satisfied, compared with the case in which multiple phase control periods having different numbers of cycles are not used.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including a fixing member, a heating element, a power supply circuit, and a processor. The fixing member is used in fixing on recording material. The heating element is used to heat the fixing member. The power supply circuit causes current in phase control to flow to the heating element. The processor is configured to set the phase of the current by using a combination of multiple phase control periods having different numbers of cycles supplied from an alternating-current power supply. The current flows to the heating element.

BRIEF DESCRIPTION OF THE DRAWINGS

Exemplary embodiment of the present disclosure will be described in detail based on the following figures, wherein.

DETAILED DESCRIPTION

Referring to the attached drawings, an exemplary embodiment of the present disclosure will be described in detail below.

Image Forming Apparatus 1

Figure 1:
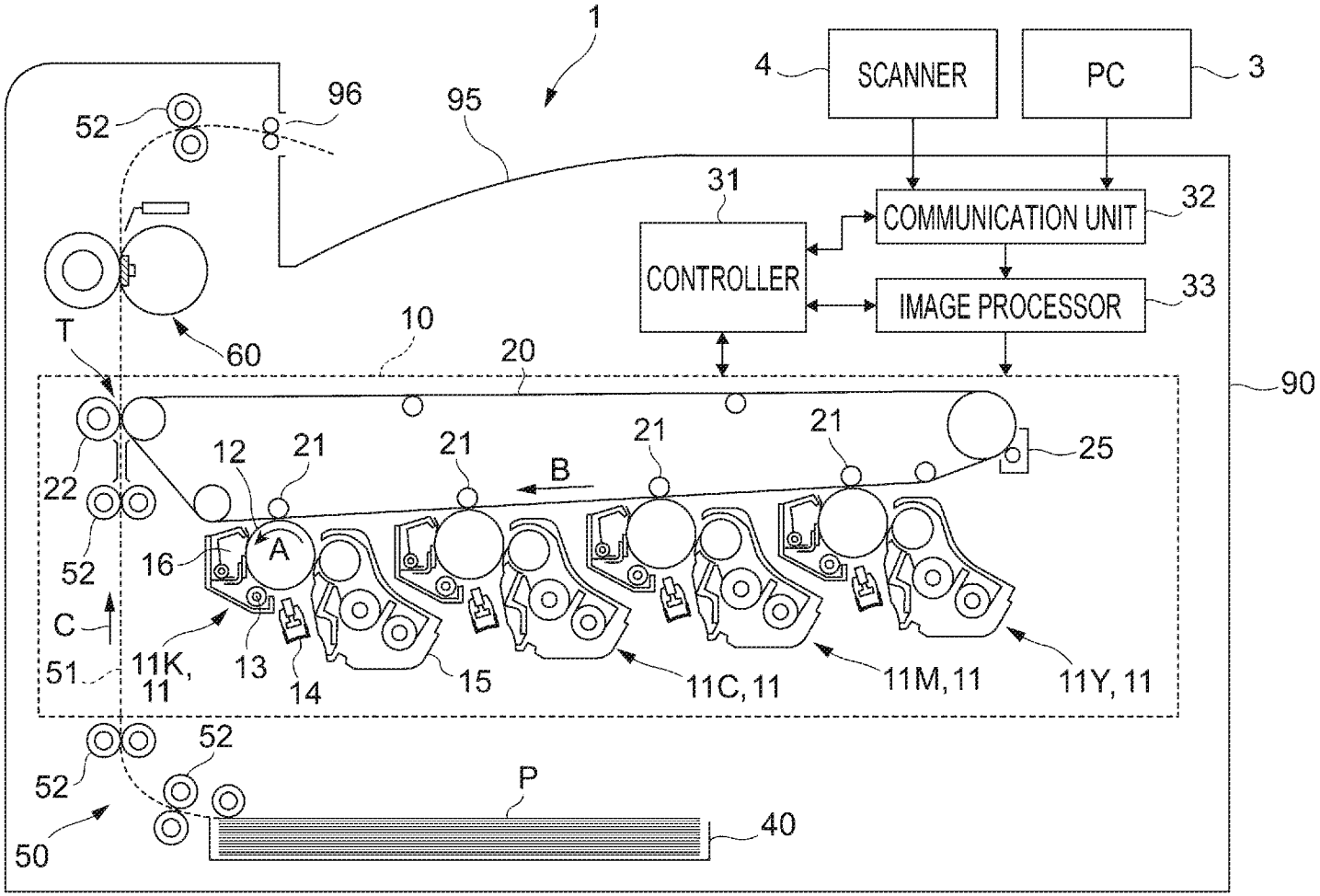
FIG. 1 is a diagram illustrating the entire configuration of an image forming apparatus.

FIG. 1 is a diagram illustrating the entire configuration of an image forming apparatus 1. Specifically, FIG. 1 is a view of the image forming apparatus 1 from its front.

The image forming apparatus 1 is a so-called electrophotographic tandem color printer which prints images on the basis of image data. The image forming apparatus 1 includes, inside a body case 90, a sheet holding unit 40 which holds sheets P, an image forming unit 10 which forms toner images on a sheet P, a transport unit 50 which transports a sheet P from the sheet holding unit 40 through the image forming unit 10 to a sheet eject portion 96 of the body case 90, and a fixing unit 60 which fixes toner images on a sheet P. In addition, the image forming apparatus 1 includes a controller 31 which controls operations of the entire image forming apparatus 1, a communication unit 32 which communicates, for example, with a personal computer (PC) 3 or an image reading apparatus (scanner) 4 and receives image data, and an image processor 33 which performs image processing on image data received by the communication unit 32.

The sheet holding unit 40 holds sheets P.

The transport unit 50 includes a transport path 51, for a sheet P, which extends from the sheet holding unit 40 through the image forming unit 10 to the sheet eject portion 96, and transport rollers 52 which transport a sheet P along the transport path 51. The transport unit 50 transports a sheet P in the arrow C direction.

The image forming unit 10 includes four image forming units 11Y, 11M, 11C, and 11K disposed at predetermined intervals. When the image forming units 11Y, 11M, 11C, and 11K are not differentiated from each other, they are denoted as image forming units 11. Each image forming unit 11 includes a photoreceptor drum 12 which forms an electrostatic latent image and holds a toner image, a charger 13 which charges the surface of the photoreceptor drum 12 at a predetermined potential, a light emitting diode (LED) print head 14 which exposes, to light, the photoreceptor drum 12, which has been charged by the charger 13, on the basis of image data for the corresponding color, a developer 15 which develops the electrostatic latent image formed on the surface of the photoreceptor drum 12, and a drum cleaner 16 which cleans the surface of the photoreceptor drum 12 after transfer.

The four image forming units 11Y, 11M, 11C, and 11K are formed similarly to each other except toner stored in the developers 15. The image forming unit 11Y including the developer 15 storing yellow (Y) toner forms a yellow toner image. Similarly, the image forming unit 11M including the developer 15 storing magenta (M) toner forms a magenta toner image; the image forming unit 11C including the developer 15 storing cyan (C) toner forms a cyan toner image; the image forming unit 11K including the developer 15 storing black (K) toner forms a black toner image.

The image forming unit 10 includes an intermediate transfer belt 20 onto which the color toner images formed on the photoreceptor drums 12 of the image forming units 11 are subjected to multiple transfer so as to be superimposed on each other, and first transfer rollers 21 which cause color toner images, which are formed by the image forming units 11, to be subjected to electrostatic transfer (first transfer) sequentially onto the intermediate transfer belt 20. In addition, the image forming unit 10 includes a second transfer roller 22 of a second transfer unit T which causes the superimposed toner image, which has been formed in such a manner that the color toner images are transferred onto the surface of the intermediate transfer belt 20 so as to be superimposed on each other, to be subjected to electrostatic transfer (second transfer) onto a sheet P at a time. The image forming unit 10 is an exemplary toner image forming apparatus.

The image forming apparatus 1 forms images according to the following process under the control exerted on operations by the controller 31. That is, image data transmitted from the PC 3 or the scanner 4 is received by the communication unit 32, and is subjected to predetermined image processing by the image processor 33. Then, image data for each of the colors is formed, and is transmitted to the image forming unit 11 for the color. For example, in the image forming unit 11K which forms a black toner image, while rotating in the arrow A direction, the photoreceptor drum 12 is charged at the predetermined potential by the charger 13. After that, the print head 14 scans and exposes, to light, the photoreceptor drum 12 on the basis of black-image data transmitted from the image processor 33. Thus, an electrostatic latent image corresponding to the black-image data is formed on the surface of the photoreceptor drum 12. The black electrostatic latent image formed on the photoreceptor drum 12 is developed by the developer 15. Thus, a black toner image is formed on the photoreceptor drum 12. Similarly, the image forming units 11Y, 11M, and 11C form yellow (Y), magenta (M), and cyan (C) toner images, respectively.

The color toner images formed on the photoreceptor drums 12 of the image forming units 11 are subjected to electrostatic transfer sequentially by the first transfer rollers 21 onto the intermediate transfer belt 20 travelling in the arrow B direction. A superimposed toner image, in which the color toner images are superimposed on each other, is formed on the intermediate transfer belt 20. The intermediate transfer belt 20 travels in the arrow B direction. Thus, the superimposed toner image on the intermediate transfer belt 20 is transported to the second transfer unit T. At the timing at which the superimposed toner image is transported to the second transfer unit T, a sheet P in the sheet holding unit 40 is transported by the transport rollers 52 of the transport unit 50 along the transport path 51 in the arrow C direction. The superimposed toner image formed on the intermediate transfer belt 20 is subjected to electrostatic transfer by the second transfer unit T at a time onto the sheet P, which has been transported along the transport path 51, by using a transfer electric field formed by the second transfer roller 22. The sheet P, onto which the superimposed toner image is subjected to electrostatic transfer at a time, is exemplary recording material. Instead of the superimposed toner image, a single-color toner image may be used.

After that, the sheet P, onto which the superimposed toner image has been subjected to electrostatic transfer, is transported along the transport path 51 to the fixing unit 60. The superimposed toner image on the sheet P, which has been transported to the fixing unit 60, is subjected to heat and pressure by the fixing unit 60, and is fixed onto the sheet P. The sheet P, on which the fixed superimposed toner image is formed, is transported along the transport path 51 in the arrow C direction, and is ejected from the sheet eject portion 96 of the body case 90. Then, the sheet P is loaded onto a sheet loading unit 95 on which sheets are loaded. In contrast, the remaining toner on the photoreceptor drums 12 after first transfer and the remaining toner on the intermediate transfer belt 20 after second transfer are removed by the drum cleaners 16 and a belt cleaner 25, respectively.

The process in which the image forming apparatus 1 prints an image on a sheet P is repeatedly performed multiple times, as many as the number of prints.

Fixing Unit 60

Figure 2:
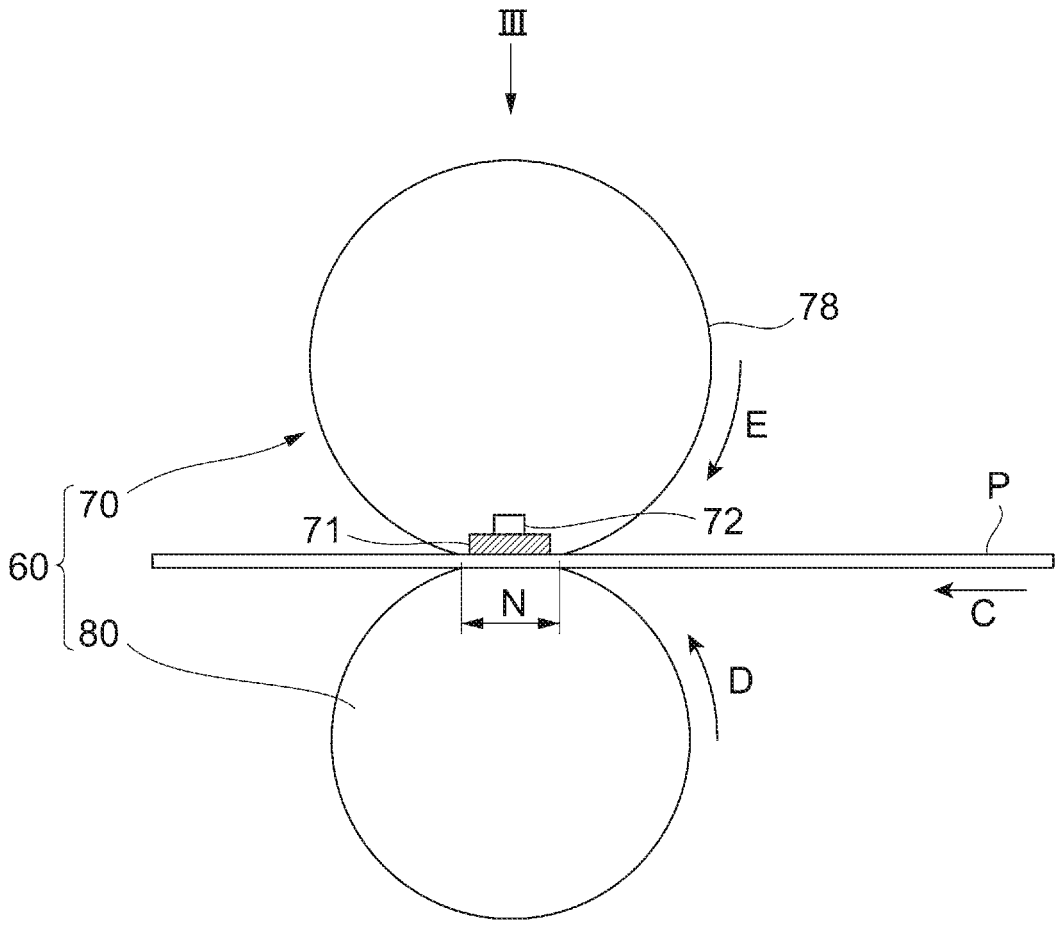
FIG. 2 is a sectional view of a fixing unit in an image forming apparatus.

FIG. 2 is a sectional view of the fixing unit 60 of the image forming apparatus 1.

The fixing unit 60 includes a fixing belt module 70 and a pressure roller 80. The fixing belt module 70 and the pressure roller 80 are formed in the cylinder shape with their shafts extending beyond FIG. 2 away from the viewer. The fixing unit 60 is disposed on the transport path 51 in the image forming apparatus 1 illustrated in FIG. 1. Specifically, the fixing belt module 70 in the fixing unit 60 is disposed on the right of the transport path 51 in the transport unit 50. The pressure roller 80 is disposed on the left of the transport path 51. A sheet P transported along the transport path 51 is nipped between the fixing belt module 70 and the pressure roller 80.

The fixing belt module 70 includes a rotating fixing belt 78 (exemplary fixing member), a ceramic heater 71 (exemplary heating element) which produces heat, and a thermistor 72 which detects the temperature of the ceramic heater 71.

The ceramic heater 71 is formed integrally in such a manner that heaters (heaters 711 and 712 in FIG. 3 which are described below), which are built in an alumina or silicon nitride ceramic serving as a base, are sintered as a whole. Thus, the heaters are sealed from the outside air completely, and are protected and insulted. The ceramic heater 71 is a planar member whose longitudinal direction matches the direction perpendicular to the plane of the drawing, and has a low heat capacity. The thermistor 72, which is a temperature detecting device, is a member whose resistance value changes in accordance with temperature. As illustrated in FIG. 2, the thermistor 72 is fixed so as to adhere to the ceramic heater 71 on the opposite side of the fixing belt 78 side of the ceramic heater 71 so that the thermistor 72 easily detects the temperature of the ceramic heater 71. In addition to the fixing belt 78, the ceramic heater 71, and the thermistor 72, the fixing belt module 70 includes a supporting member (not illustrated) which supports the fixing belt 78 from the inside gently so that the fixing belt 78 rotates.

The fixing belt 78, which is an endless belt in the cylindrical shape, is disposed so that its inner surface is in contact with the outer face of the ceramic heater 71. The fixing belt 78 is heated due to the contact with the ceramic heater 71. The fixing belt 78 is formed of an endless belt member whose original shape is cylindrical. For example, the fixing belt 78 is formed so that the diameter of the original shape (the cylindrical shape) is 30 mm, and the length in the width direction (the direction perpendicular to the plane of the drawing) is 300 mm. As described below, the shape of the fixing belt 78 is changed due to the pressure from the ceramic heater 71. The original shape indicates the state without the pressure from the ceramic heater 71, that is, the state in which the shape is not changed.

The fixing belt 78 is formed of a base material layer and a release layer covered on the base material layer. The base material layer is formed of a heat-resistant sheet member which forms the mechanical strength over the entire fixing belt 78. As the base material layer, for example, a sheet whose thickness is 60 μm to 200 μm and which is made of a polyimide resin is used. To make the temperature distribution of the fixing belt 78 more uniform, a thermally conductive filler made, for example, of aluminum may be contained in the polyimide resin.

The release layer, which is in direct contact with an unfixed toner image held on a sheet P, uses a material having high mold releasability. For example, tetrafluoroetylene-perfluoroalkyl vinyl ether copolymer (PFA), polytetrafluoroethylene (PTFE), silicone copolymer, or a composite layer of these is used. A release layer whose thickness is too thin causes insufficient wear resistance, making the life of the fixing belt 78 short. In contrast, a release layer whose thickness is too thick makes the heat capacity of the fixing belt 78 too large, making the warmup time long. Therefore, the thickness of a release layer is desirably between 1 μm and 50 μm in consideration of the balance between the wear resistance and the heat capacity.

An elastic layer made, for example, of silicone rubber may be included between the base material layer and the release layer.

The ceramic heater 71 is supported by a supporting member on the inner side of the fixing belt 78. The pressure roller 80 is disposed and fixed over the entire area, in the shaft direction, in which the pressure roller 80 presses against the fixing belt 78. The ceramic heater 71 presses against the pressure roller 80 through the fixing belt 78 uniformly with a predetermined load (for example, 10 kgf in average) over a nip portion N which is an area having a predetermined width.

The pressure roller 80 is disposed so as to face the fixing belt 78, and rotates in the arrow D direction in FIG. 2 in accordance with the fixing belt 78, for example, at a processing speed of 140 mm/s. The fixing belt 78 is nipped between the pressure roller 80 and the ceramic heater 71, which forms the nip portion (fixing pressing unit) N. For example, the pressure roller 80 has a laminated structure having a stainless or aluminum solid core (cylindrical cored bar) having a diameter of 18 mm, a heat-resistant elastic body layer made, for example, of silicone sponge whose thickness is, for example, 5 mm and which is covered over the outer surface of the core, and, further, a release layer with heat-resistant resin coating or heat-resistant rubber coating which is made, for example, of carbon compounded PFA and whose thickness is, for example, 50 μm. A pressure spring (not illustrated) presses the ceramic heater 71 via the fixing belt 78, for example, at a load of 25 kgf.

The sheet P transported to the nip portion N by the transport unit 50 (see FIG. 1) is heated by the fixing belt 78 in the nip portion N, and is pressed by the ceramic heater 71 and the pressure roller 80 through the fixing belt 78, causing the unfixed superimposed toner image, which is held on the sheet P, to be fixed onto the sheet P. In the nip portion N, the sheet P, which is in contact with the pressure roller 80, is transported in the arrow C direction due to the rotation of the pressure roller 80 in the arrow D direction. The travelling of the sheet P causes the fixing belt 78, which is in contact with the sheet P, to be driven, causing the fixing belt 78 to rotate in the arrow E direction (travelling direction).

The ceramic heater 71 is described above as a heating element. Alternatively, a heating element such as a different solid heater may be used. The fixing belt 78 is described above as a fixing member. A member which does not rotate may be used as a fixing member. A member, which is heated by the ceramic heater 71 and is pressed by the pressure roller 80 and which fixes an unfixed superimposed toner image onto a sheet P transported to the nip between the member and the pressure roller 80, may be used. The thermistor 72 is described above as a temperature detecting device. Alternatively, a different temperature detecting device such as a thermocouple may be used.

Power Supply Circuit 73 of Ceramic Heater 71

As described below, the ceramic heater 71 is connected to a commercial alternating-current power supply (an alternating-current power supply 5 in FIG. 3 described below) via switching devices. Specifically, the ceramic heater 71 is supplied with power from the commercial alternating-current power supply and produces heat. On the basis of the temperature of the ceramic heater 71 detected through the thermistor 72, power supply from the alternating-current power supply is switched on/off by using the switching devices. Thus, the temperature of the ceramic heater 71 is maintained at the target temperature.

The methods of switching on/off power supply from the alternating-current power supply are phase control and wave number control. The phase control is a method of controlling power, which is supplied to the ceramic heater 71, by switching on a switching device at any phase angle within one half wave of the alternating-current waveform. In contrast, the wave number control is the method of controlling power, which is supplied to the ceramic heater 71, by switching on a switching device by using, as a unit, a half wave of the alternating-current waveform.

In the wave number control, current flows on a half-wave-by-half-wave basis. Thus, the period of a change in current is made long, causing flicker to occur easily. Flicker indicates the state in which lighting devices connected to the same alternating-current power supply flicker due to a change in current. Therefore, in this example, the phase control is used to control power supplied to the ceramic heater 71.

Figure 3:
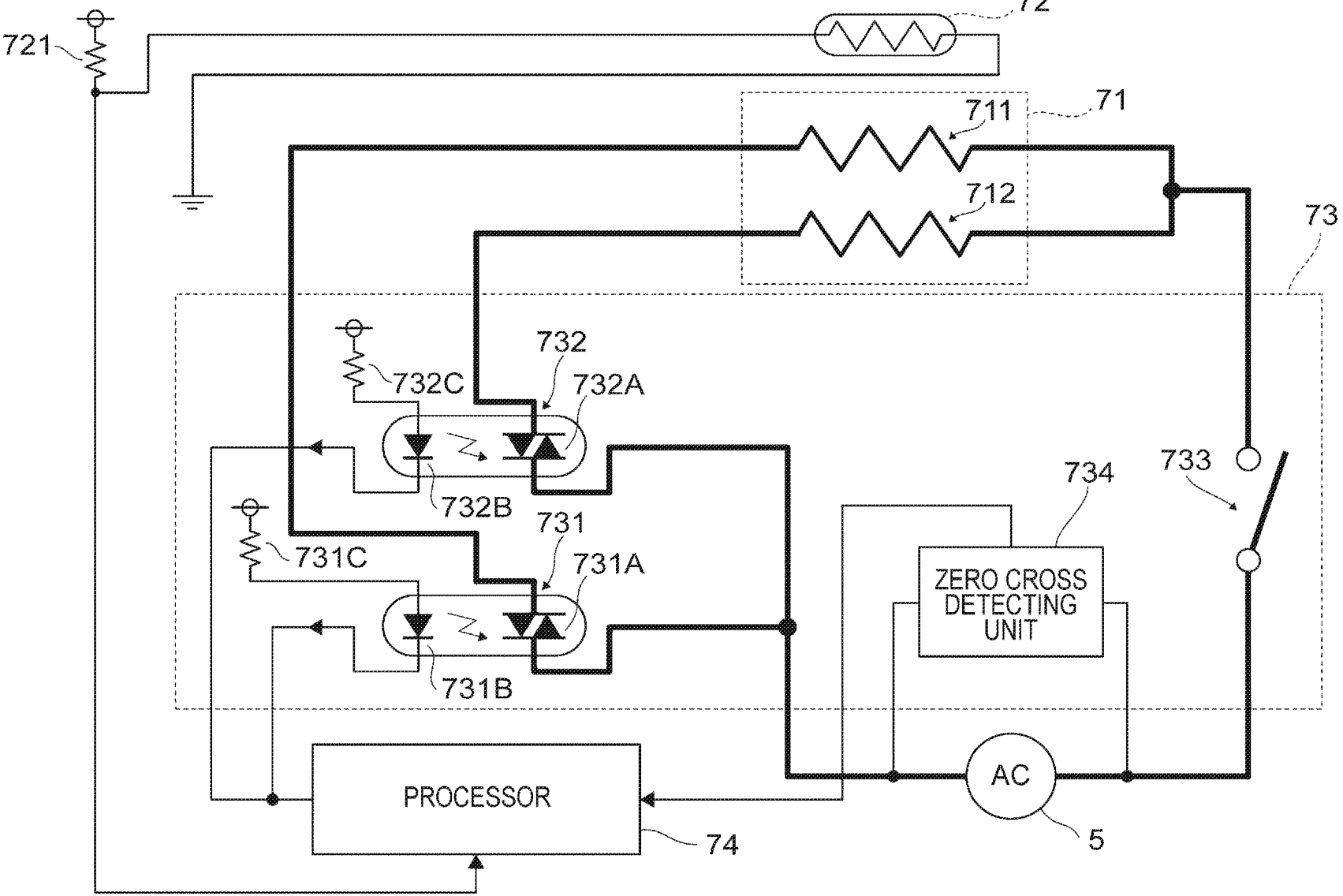
FIG. 3 is a diagram illustrating an exemplary power supply circuit which supplies current to a ceramic heater in phase control.

FIG. 3 is a diagram illustrating an exemplary power supply circuit 73 which supplies the ceramic heater 71 with current in phase control. FIG. 3 illustrates, in addition to the power supply circuit 73, the alternating-current power supply 5, the ceramic heater 71, the thermistor 72, a resistor 721 connected to the thermistor 72, and a processor 74 which controls the power supply circuit 73. The alternating-current power supply 5 is a commercial power supply whose frequency is 50 Hz or 60 Hz and whose voltage ranges between 100 V (rms) and 240 V (rms). In this example, it is assumed that the ceramic heater 71 has the two heaters 711 and 712 disposed in parallel. The ceramic heater 71 may have a single heater or three or more heaters.

The power supply circuit 73 includes phototriac couplers 731 and 732 which control current flowing through the two heaters 711 and 712, respectively, a relay 733 which switches between the operating state and the non-operating state, and resistors 731C and 732C connected to the phototriac couplers 731 and 732. The power supply circuit 73 includes a zero cross detecting unit (zero cross detecting circuit) 734 which detects time points at which the waveform of the alternating-current power supply 5 reaches "0" (0 V or 0 A). A time point at which the waveform of the alternating-current power supply 5 reaches "0" is denoted as a zero cross point.

The thermistor 72 is connected in series to the resistor 721, and the connecting point between the thermistor 72 and the resistor 721 is connected to the processor 74. The side (terminal) of the resistor 721, to which the thermistor 72 is not connected, is connected to a direct-current power supply, and the side (terminal) of the thermistor 72, to which the resistor 721 is not connected, is grounded. The voltage of the direct-current power supply is divided by using the thermistor 72 and the resistor 721, and is received by the processor 74. Thus, the processor 74 detects the temperature of the ceramic heater 71 by using a change in the resistance value of the thermistor 72.

The phototriac coupler 731 includes a triac 731A which is a switching device that switches on/off a current which flows through the heater 711, and a light-emitting diode 731B which emits light to the triac 731A to switch the triac 731A from off to on. The triac 731A has a configuration in which two PNPN thyristor devices are connected to each other in antiparallel. The triac 731A has a first terminal connected to a first terminal of the heater 711. A second terminal of the heater 711 is connected to a first terminal of the alternating-current power supply 5 via the relay 733. The triac 731A has a second terminal connected to a second terminal of the alternating-current power supply 5. Even when the relay 733 is on, if the triac 731A is off, a current does not flow from the alternating-current power supply 5 to the heater 711.

The light-emitting diode 731B has a first terminal (the anode side) connected to a first terminal of the resistor 731C. The resistor 731C has a second terminal connected to a direct-current power supply. The light-emitting diode 731B has a second terminal (the cathode side) connected to the processor 74. The resistor 731C limits a current flowing through the light-emitting diode 731B.

When the light-emitting diode 731B is to be lit, the processor 74 grounds the second terminal of the light-emitting diode 731B inside the processor 74. Then, a current flows through the light-emitting diode 731B from the direct-current power supply via the resistor 731C to the ground. This causes the light-emitting diode 731B to change from the non-light-emitting state (off) to the light-emitting state (on). Then, light emitted by the light-emitting diode 731B, which outputs light, produces a photocurrent on the PN junction surface, which produces a gate current to switch on the triac 731A. Thus, when the relay 733 is on, an alternating current flows through the heater 711 from the alternating-current power supply 5, causing the heater 711 to produce heat. The triac 731A, which is a thyristor, is switched off when the wave of the alternating-current power supply 5 reaches "0". That is, at a timing at which the light-emitting diode 731B lights, the triac 731A is switched on, and a current starts to flow through the heater 711. Specifically, at a timing of a phase angle at which a current starts to flow in one half wave, the processor 74 causes the light-emitting diode 731B to light. Thus, the processor 74 controls the phase of the current flowing through the heater 711. When the alternating current reaches a zero cross point, the triac 731A is switched off. That is, a current flows through the triac 731A in one half wave from a timing, at which the light-emitting diode 731B lights, to a zero cross point. Thus, the processor 74 controls heating of the heater 711 in the phase control.

Similarly, the phototriac coupler 732 includes a triac 732A and a light-emitting diode 732B which switches the triac 732A from off to on through light irradiation. The phototriac coupler 732 has a connection configuration similar to that of the phototriac coupler 731, and operates similarly to the phototriac coupler 731.

The direct-current power supply is a power supply which causes the processor 74, the thermistor 72, the light-emitting diodes 731B and 732B, and the zero cross detecting unit 734 to operate.

The fixing belt 78 which is an exemplary fixing member described above, the ceramic heater 71 which is an exemplary heating element, the power supply circuit 73, and the processor 74 indicate an exemplary fixing device.

Harmonic Wave Noise

Figure 4A:
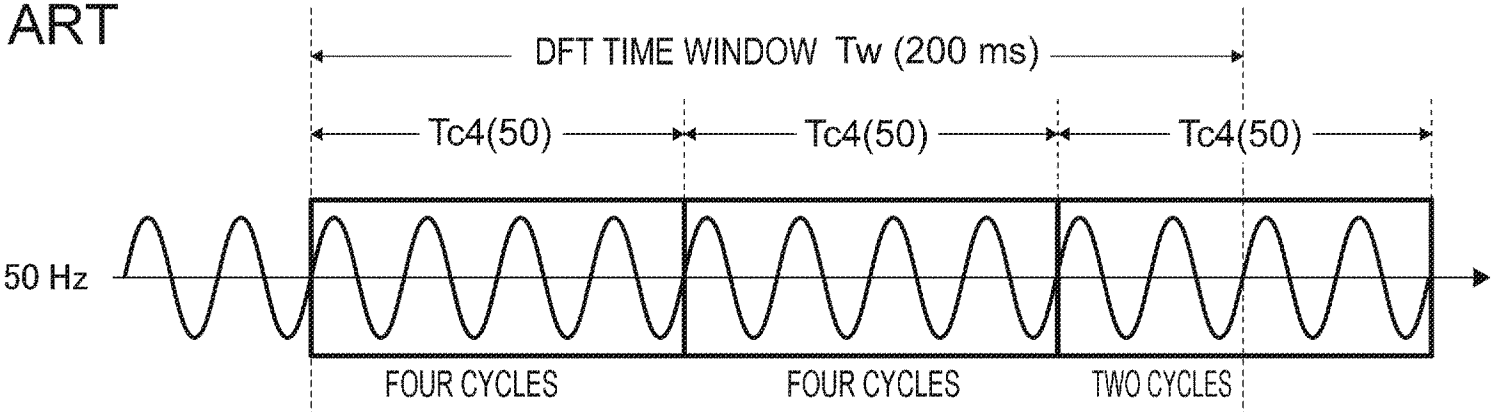
FIG. 4A RELATED ART
FIG. 4A is diagram for describing phase control periods used in phase control in the case where the present exemplary embodiment is not applied and where an alternating-current power supply is 50 Hz.
Figure 4B:
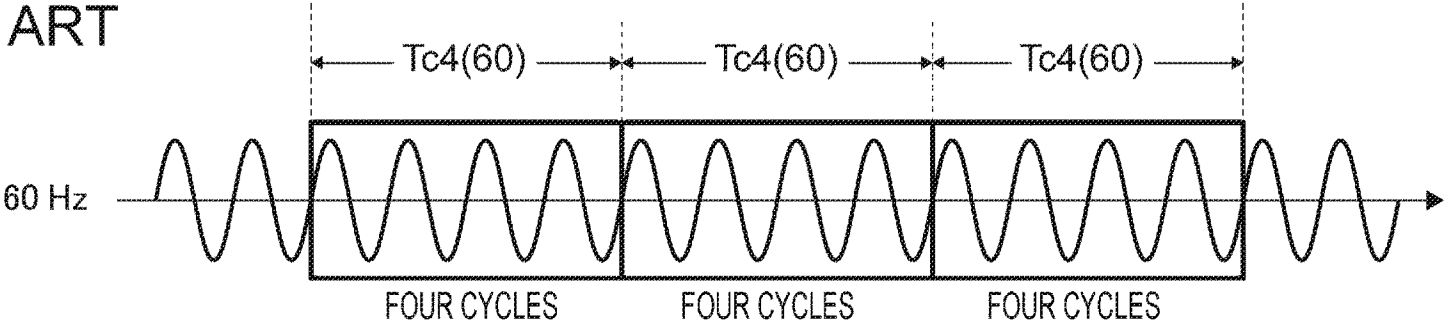
FIG. 4B RELATED ART
FIG. 4B is diagram for describing phase control periods used in phase control in the case where the present exemplary embodiment is not applied and where an alternating-current power supply is 60 Hz.

FIGS. 4A and 4B are diagrams for describing phase control periods used in phase control in the case where the present exemplary embodiment is not applied. FIG. 4A illustrates the case in which the alternating-current power supply 5 is 50 Hz. FIG. 4B illustrates the case in which the alternating-current power supply 5 is 60 Hz. A phase control period Tc is a period in which multiple cycles in the waveform of the alternating-current power supply 5 are used as a section, and in which, in accordance with the ratio (hereinafter denoted as a duty) of power supplied to the heaters (heaters 711 and 712), the phase angle for switching on in the phase control period is set. When the frequency of the alternating-current power supply 5 is to be differentiated, a phase control period for 50 Hz is denoted as a phase control period Tc (50), and a phase control period for 60 Hz is denoted as a phase control period Tc (60).

A Discrete Fourier Transformation (DFT) time window Tw indicates a period used in measurement of harmonic wave noise, and is defined in the harmonic wave standard defined internationally. The period is 200 ms regardless of the frequency of the alternating-current power supply 5.

In this example, one phase control period Tc includes four cycles. Accordingly, the phase control period Tc is denoted as a phase control period Tc4. As illustrated in FIG. 4A, since one cycle for 50 Hz is 20 ms, one phase control period Tc4 (50) is 80 ms. The DFT time window Tw includes 2.5 phase control periods Tc4 (50). That is, for 50 Hz, the DFT time window Tw is a non-integer multiple of one phase control period Tc4 (50). In contrast, since one cycle for 60 Hz is 16.72 ms, one phase control period Tc4 (60) is 66.7 ms. The DFT time window Tw includes three phase control periods Tc4 (60). That is, for 60 Hz, the DFT time window Tw is an integer multiple of one phase control period Tc4 (60).

Figure 5A:
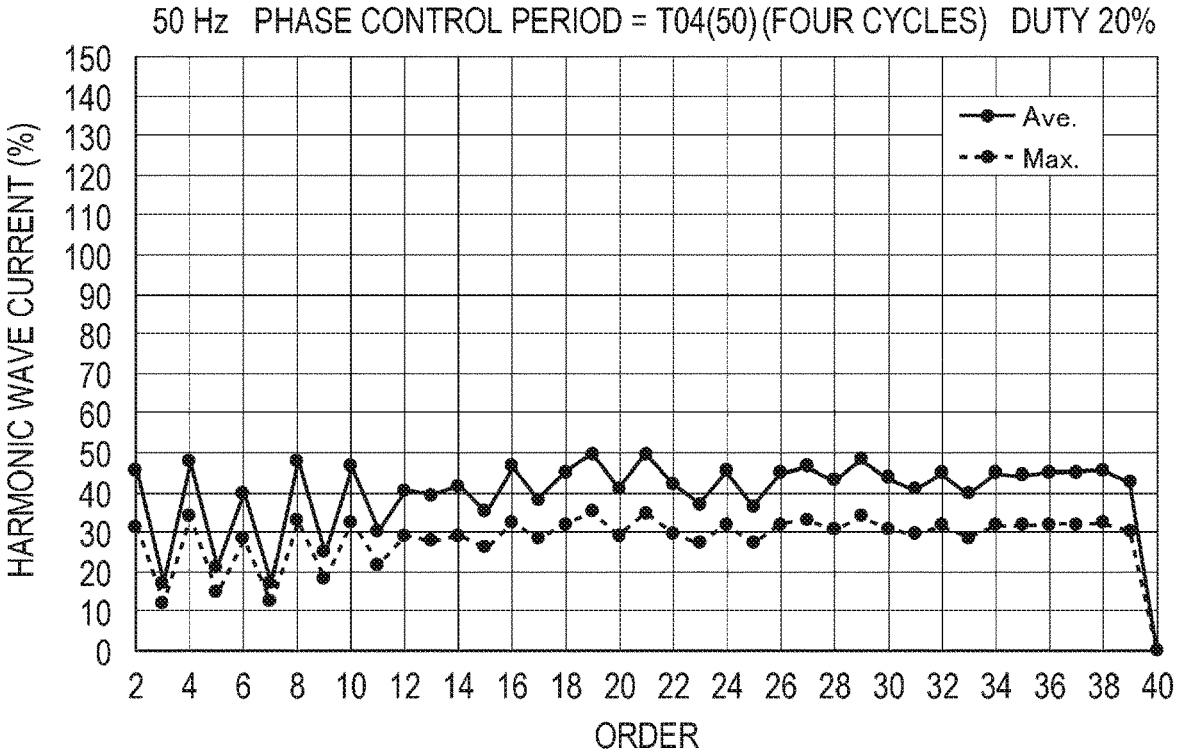
FIG. 5A RELATED ART
FIG. 5A is a diagram for describing a harmonic wave current in phase control, which is illustrated in FIG. 4A, in the case where the present exemplary embodiment is not applied and where an alternating-current power supply is 50 Hz.
Figure 5B:
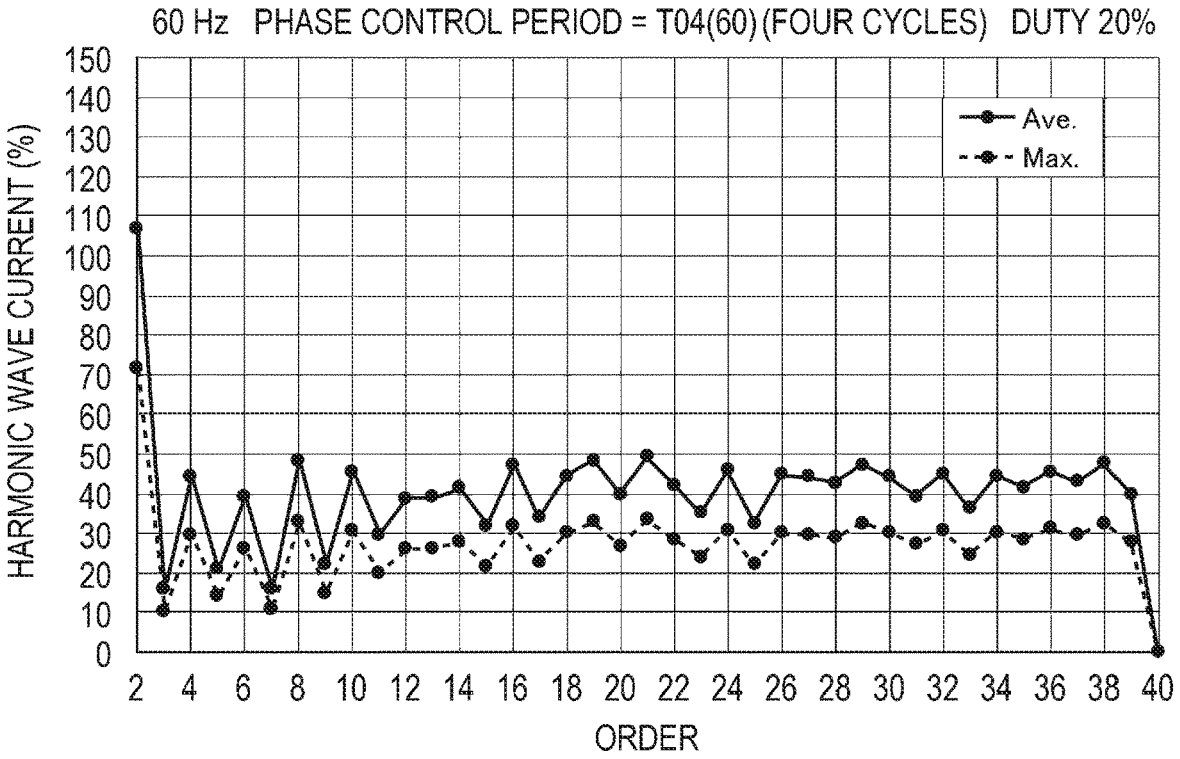
FIG. 5B RELATED ART
FIG. 5B is a diagram for describing a harmonic wave current in phase control, which is illustrated in FIG. 4B, in the case where the present exemplary embodiment is not applied and where an alternating-current power supply is 60 Hz.

FIGS. 5A and 5B are diagrams for describing harmonic wave current in phase control, which is illustrated in FIGS. 4A and 4B, in the case where the present exemplary embodiment is not applied. FIG. 5A illustrates the case in which the alternating-current power supply 5 is 50 Hz. FIG. 5B illustrates the case in which the alternating-current power supply 5 is 60 Hz. As described above, one phase control period Tc includes four cycles. FIGS. 5A and 5B illustrate the case of a duty of 20%. The horizontal axis indicates the order of harmonic wave from the second order to the 40th order. The vertical axis indicates the ratio (harmonic wave current (%)) of harmonic wave current obtained in the case where the threshold (limit value) defined in the harmonic wave standard is set to 100%. The average (Ave.) and the maximum (Max.), which are obtained in measurement, are illustrated by using the harmonic wave current (%).

In the case in FIG. 5A in which the alternating-current power supply 5 is 50 Hz, both the average (Ave.) and the maximum (Max.) of the harmonic wave current are small, that is, equal to or less than 50% with respect to the threshold (100%), which is defined in the harmonic wave standard, at all of the orders with which measurement is performed. In contrast, in the case in FIG. 5B in which the alternating-current power supply 5 is 60 Hz, the average (Ave.) of the second-order harmonic wave current exceeds the threshold (100%) defined in the harmonic wave standard. The maximum (Max.) of the second-order harmonic wave current is close to the threshold (100%) defined in the harmonic wave standard. The harmonic wave current at the other orders is equal to or less than 50% with respect to the threshold (100%) defined in the harmonic wave standard.

Figure 6A:
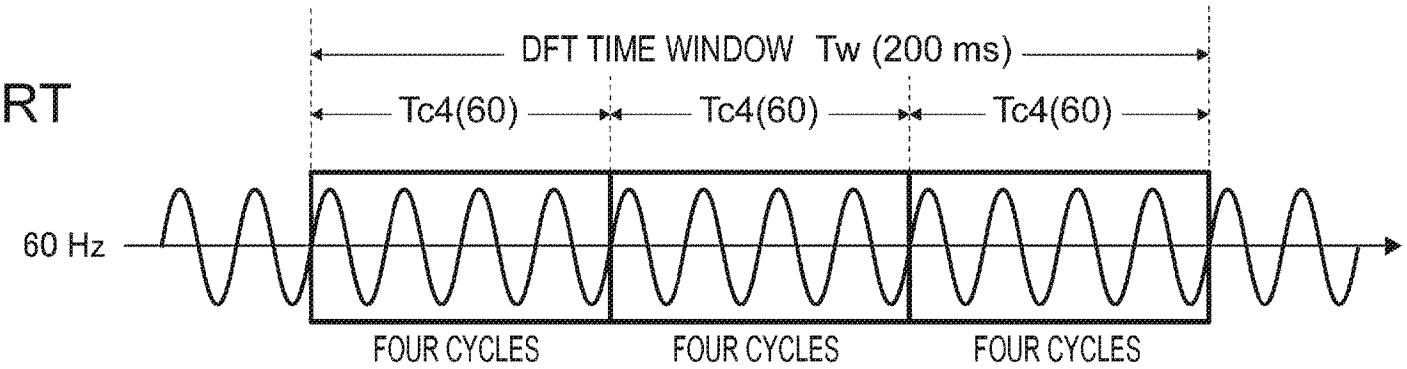
FIG. 6A RELATED ART
FIG. 6A is a diagram for describing the relationship between a Discrete Fourier Transformation (DFT) time window and phase control periods in the case where an alternating-current power supply is 60 Hz.
Figure 6B:
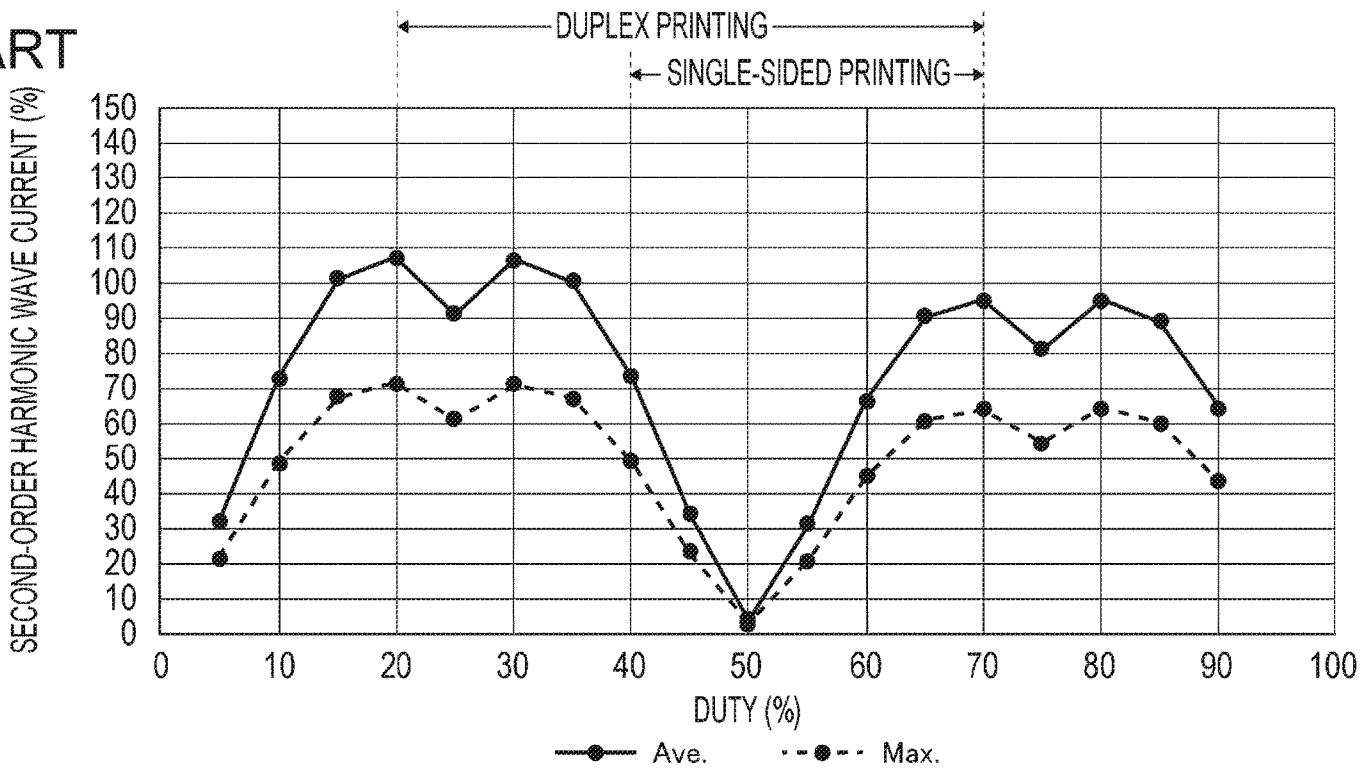
FIG. 6B RELATED ART
FIG. 6B is a diagram for describing the relationship between duties and a second-order harmonic wave current in the case where an alternating-current power supply is 60 Hz.

FIGS. 6A and 6B are diagrams for describing the relationship between duties and the second-order harmonic wave current in the case where the alternating-current power supply 5 is 60 Hz. FIG. 6A illustrates the relationship between the DFT time window Tw and the phase control periods Tc4 (60). FIG. 6B illustrates the relationship between duties and the second-order harmonic wave current. FIG. 6A is the same as FIG. 4B. In FIG. 6B, the horizontal axis indicates the duty (%). The vertical axis indicates the ratio (harmonic wave current (%)) of the second-order harmonic wave current with respect to the threshold (100%) defined in the harmonic wave standard. The average (Ave.) and the maximum (Max.), which are obtained in measurement, are illustrated by using the harmonic wave current (%).

FIG. 5B shows that, in the case where the alternating-current power supply 5 is 60 Hz, the second-order harmonic wave current at a duty of 20% exceeds the threshold (100%) defined in the harmonic wave standard. As illustrated in FIG. 6B, the second-order harmonic wave current (%) in the case where the alternating-current power supply 5 is 60 Hz depends on the duties. That is, the harmonic wave current (%) is large at the duties in the ranges between 10% and 40% inclusive and between 60% and 90% inclusive. Especially, the harmonic wave current (%) is large at the duties in the ranges between 15% and 35% inclusive and between 65% and 85% inclusive. The second-order harmonic wave current is small at and around duties of 0%, 50%, and 100%. This is because occurrence of harmonic waves is suppressed because a current at the phase angle for switching on is small in a half wave.

As described above, in the case where the alternating-current power supply 5 is 60 Hz, harmonic wave noise (harmonic wave current) is easy to occur compared with the case in which the alternating-current power supply 5 is 50 Hz. This may be because, as described in FIGS. 4A and 4B, in the case where a phase control period Tc includes four cycles (Tc4 (60)) when the alternating-current power supply 5 is 60 Hz, the period (200 ms) of the DFT time window Tw matches three phase control periods Tc4 (60), that is, the DFT time window Tw is an integer multiple of one phase control period Tc4 (60). That is, when the alternating-current power supply 5 is 60 Hz, the DFT time window Tw is synchronized with the phase control periods Tc4 (60). This may emphasize harmonic waves.

Instead of a phase control period Tc having four cycles, a phase control period Tc may have one cycle, two cycles, or three cycles. However, when the phase control period Tc has two cycles, it is known that, regardless of the frequency of the alternating-current power supply 5, harmonic wave noise is easy to occur (the harmonic wave current is made large). When one phase control period Tc has cycles, whose number is an odd number, such as one cycle or three cycles, it is known that the phase angle in phase control is difficult to set.

Figure 7A:
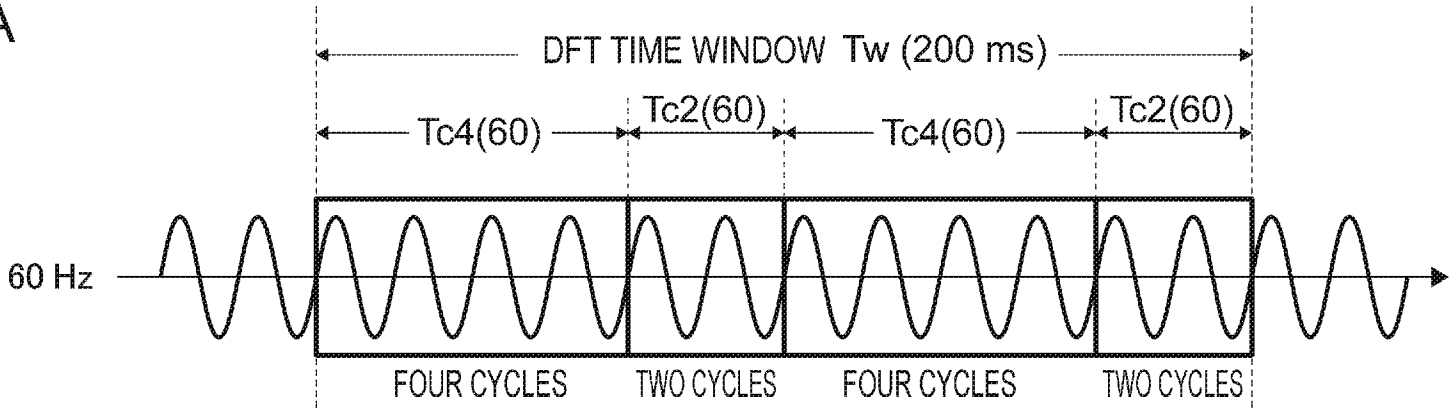
FIG. 7A is a diagram for describing phase control periods in a DFT time window to which the present exemplary embodiment is applied.
Figure 7B:
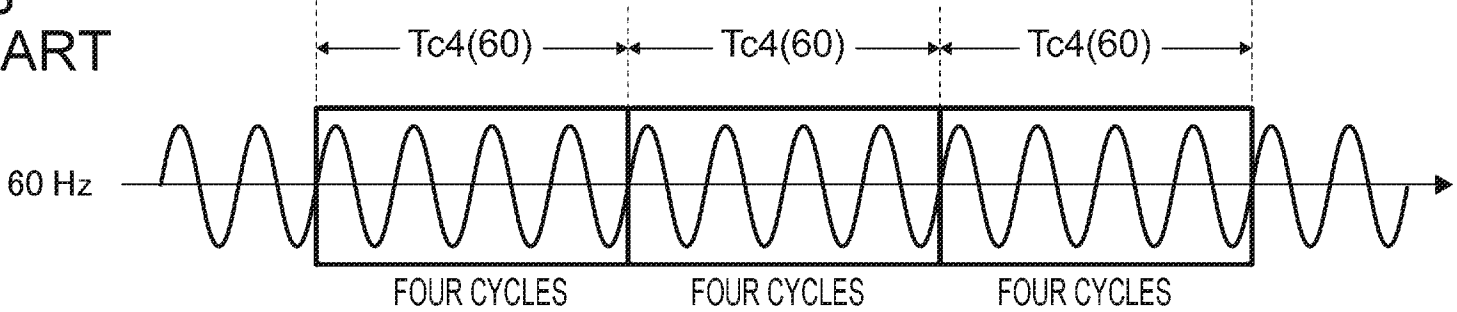
FIG. 7B RELATED ART
FIG. 7B is a diagram for describing, for comparison, phase control periods in a DFT time window to which the present exemplary embodiment is not applied.

FIGS. 7A and 7B are diagrams for describing phase control periods Tc4 (60) and Tc2 (60) in the DFT time window Tw to which the present exemplary embodiment is applied. FIG. 7A illustrates the phase control periods Tc4 (60) and Tc2 (60) in the DFT time window Tw to which the present exemplary embodiment is applied. FIG. 7B illustrates the phase control periods Tc4 (60) in the DFT time window Tw to which the present exemplary embodiment is not applied and which is illustrated for comparison. FIG. 7B illustrates the phase control periods Tc4 (60) in the DFT time window Tw illustrated in FIG. 5B.

As illustrated in FIG. 7A, the phase control periods Tc, to which the present exemplary embodiment is applied, include four-cycle phase control periods Tc4 and two-cycle phase control periods Tc2 which are set alternately. Thus, the DFT time window Tw has two phase control periods Tc4 (60) and two phase control periods Tc2 (60). That is, even when the alternating-current power supply 5 is 60 Hz, the DFT time window Tw is neither an integer multiple of a phase control period Tc4 (60) nor an integer multiple of a phase control period Tc2 (60). Both a phase control period Tc4 and a phase control period Tc2 include cycles, whose number is an even number and for which the phase angle is easy to set.

Figure 8:
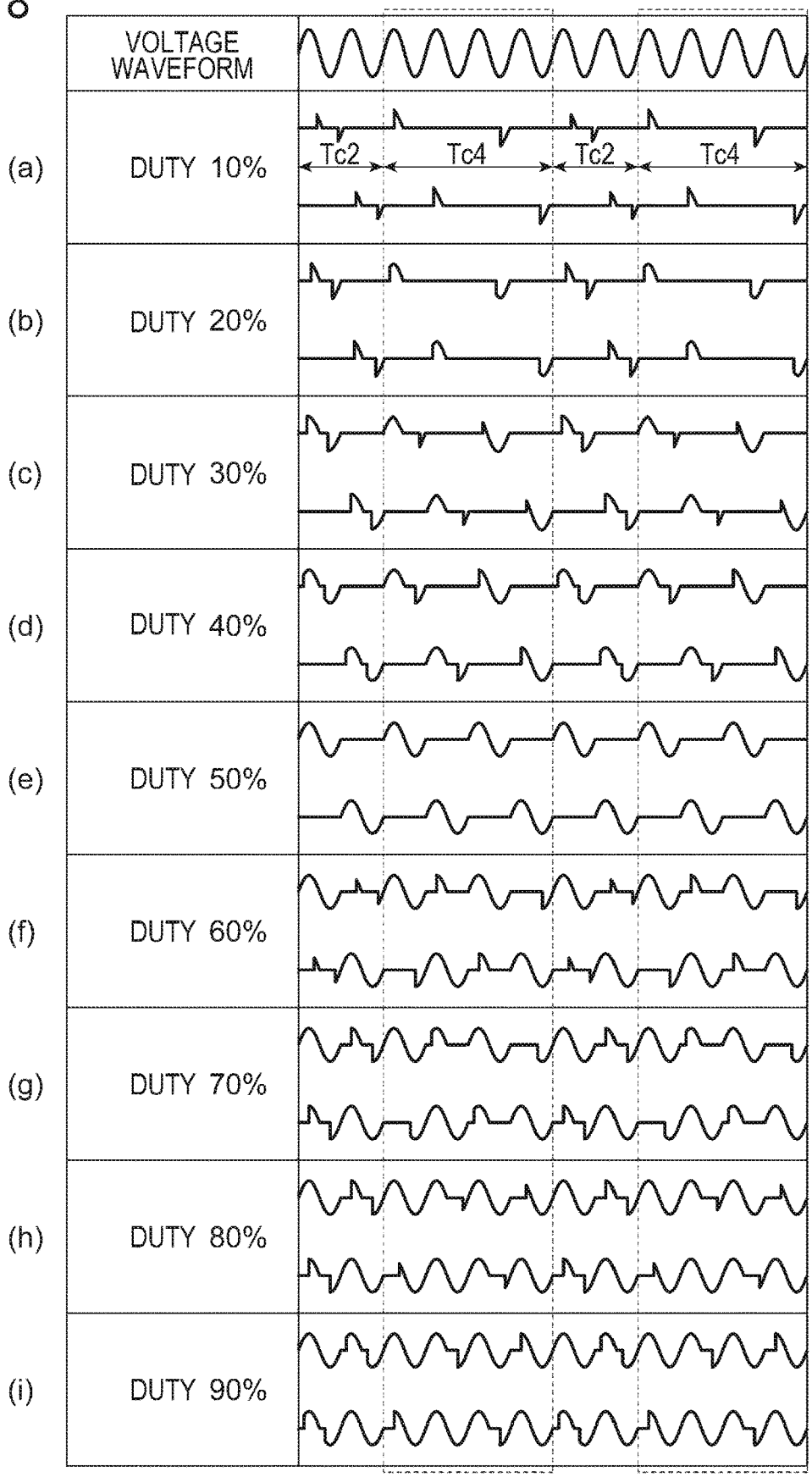
FIG. 8 is a diagram illustrating exemplary phase angles in a voltage waveform which are set in phase control using a combination of two phase control periods having different numbers of cycles.

FIG. 8 is a diagram illustrating exemplary phase angles in the voltage waveform which are set in phase control using a combination of two phase control periods Tc2 and Tc4 having different numbers of cycles. In the topmost part in FIG. 8, the voltage waveform of the alternating-current power supply 5 is illustrated. In FIG. 8, (a) to (i) correspond to the duties 10% to 90% in increments of 10%. The horizontal axis indicates the DFT time window Tw in the case where the alternating-current power supply 5 is 60 Hz. The order of phase control periods indicates a phase control period Tc2 and a phase control period Tc4 in this sequence. For each duty, two voltage waveforms are illustrated. This is because, as illustrated in FIG. 3, the ceramic heater 71 has two heaters (the heaters 711 and 712).

As illustrated in FIG. 8, two-cycle phase control periods Tc2 and four-cycle phase control period Tc4 are set so as to have the same duty. That is, in the case of a duty of 10%, the duty for the phase control periods Tc2 is set to 10%, and the duty for the phase control periods Tc4 is set to 10%. This causes a change in power supplied to the heaters (heaters 711 and 712) to be suppressed and causes a change in temperature to be suppressed. The phase angles which are set to the two heaters (heaters 711 and 712) are made different. This causes a change in temperature of the ceramic heater 71 to be suppressed.

The two-cycle phase control periods Tc2 and the four-cycle phase control periods Tc4 are set so that the on period in a positive half wave (a half wave on the positive side) matches the one period in a negative half wave (a half wave on the negative side). That is, the one period (which may be denoted as the on duty) is vertically symmetric between a positive half wave and a negative half wave. That is, it has vertical symmetry. This improves the power factor for the alternating-current power supply 5 compared with the case of not having vertical symmetry. When no problems are present in the power factor, having vertical symmetry is not necessary.

Figure 9A:
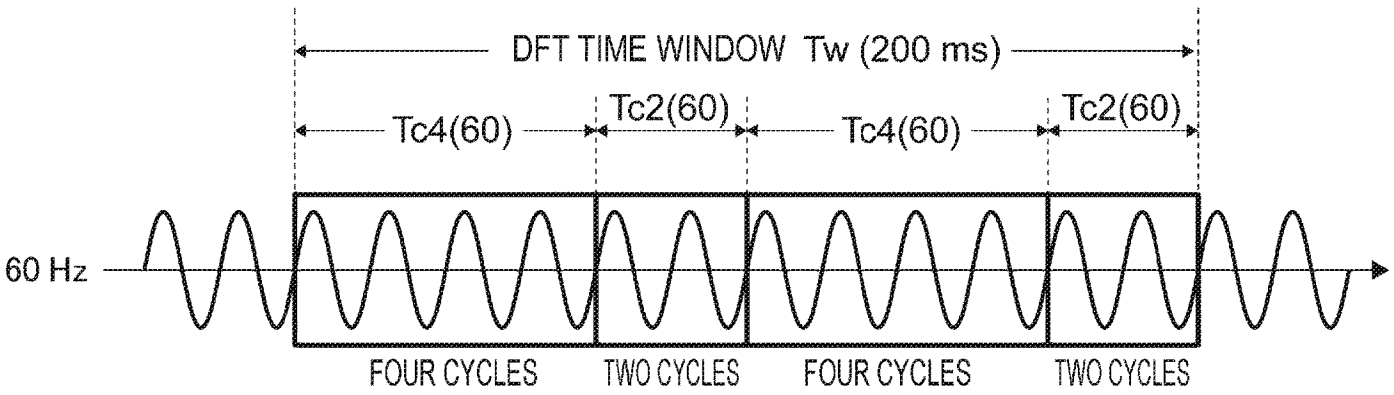
FIG. 9A is a diagram for describing the relationship between a DFT time window and two phase control periods having different numbers of cycles in the case where an alternating-current power supply is 60 Hz.
Figure 9B:
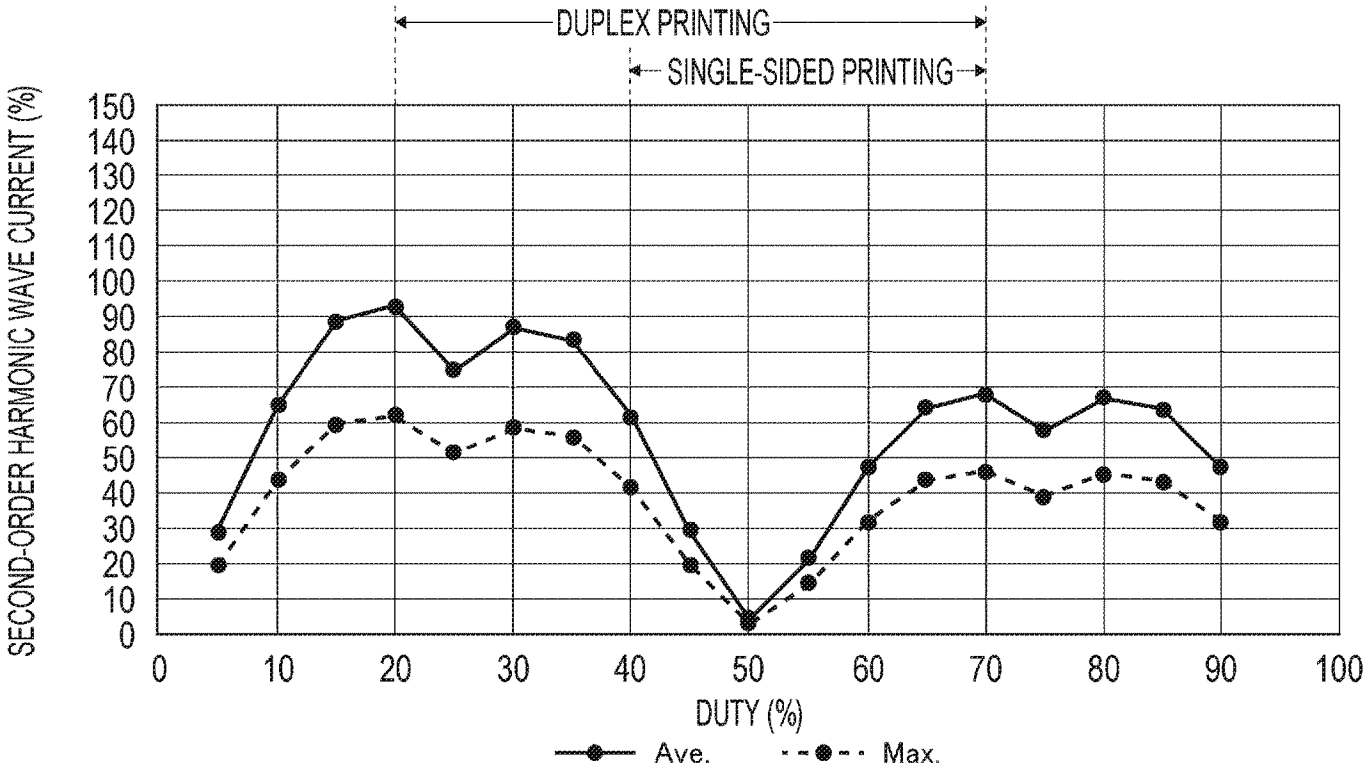
FIG. 9B is a diagram for describing the relationship between duties and a second-order harmonic wave current in the case where an alternating-current power supply is 60 Hz.

FIGS. 9A and 9B are diagrams for describing the relationship between the duties and the second-order harmonic wave current in the case where the alternating-current power supply 5 is 60 Hz. FIG. 9A illustrates the relationship between the DFT time window Tw and two phase control periods Tc2 (60) and Tc4 (60) having different numbers of cycles. FIG. 9B illustrates the relationship between the duties and the second-order harmonic wave current. FIG. 9A is the same as FIG. 7A. In FIG. 9B, the horizontal axis indicates the duty (%). The vertical axis indicates the ratio (harmonic wave current (%)) of the second-order harmonic wave current with respect to the threshold (100%) defined in the harmonic wave standard. The average (Ave.) and the maximum (Max.), which are obtained in measurement, are illustrated by using the harmonic wave current (%).

As illustrated in FIGS. 6A and 6B, in the phase control using repeated phase control periods Tc4 (60), the average (Ave.) of the harmonic wave current (%) exceeds the threshold (100%) defined in the harmonic wave standard. However, when the phase control, which uses phase control periods Tc2 (60) and phase control periods Tc4 (60) and which is illustrated in FIG. 9A, is performed, as illustrated in FIG. 9B, the average (Ave.) and the maximum (Max.) do not exceed the threshold (100%), which is defined in the harmonic wave standard, at all of the duties with which measurement is performed. That is, the combination of phase control periods Tc2 (60) and phase control periods Tc4 (60) suppresses the state in which the harmonic wave current (%) exceeds the threshold (100%) defined in the harmonic wave standard.

The phase control periods Tc2 (60) and the phase control periods Tc4 (60) may be combined with each other so that the DFT time window Tw is neither an integer multiple of a phase control period Tc2 (60) nor an integer multiple of a phase control period Tc4 (60). That is, in one DFT time window Tw, a phase control period Tc2 (60), a phase control period Tc4 (60), a phase control period Tc2 (60), and a phase control period Tc4 (60) may be arranged in this sequence. Alternatively, a phase control period Tc2 (60), a phase control period Tc2 (60), a phase control period Tc4 (60), and a phase control period Tc4 (60) may be arranged in this sequence. That is, two phase control periods Tc having different numbers of cycles may be combined with each other. Even in this case, the numbers of cycles in the two phase control periods Tc having different numbers of cycles may include an odd number. When an odd number is included, it is not easy to set the phase angle. Thus, an even number is desirable. A combination of two or more phase control periods Tc having different numbers of cycles may be used.

The description is made above under the assumption that the alternating-current power supply 5 is 60 Hz. Also in the case of the alternating-current power supply 5 of 50 Hz, a combination of phase control periods Tc4 (50) and phase control periods Tc2 (50) suppresses the state in which the harmonic wave current (%) exceeds the threshold (100%) defined in the harmonic wave standard.

Figure 10:
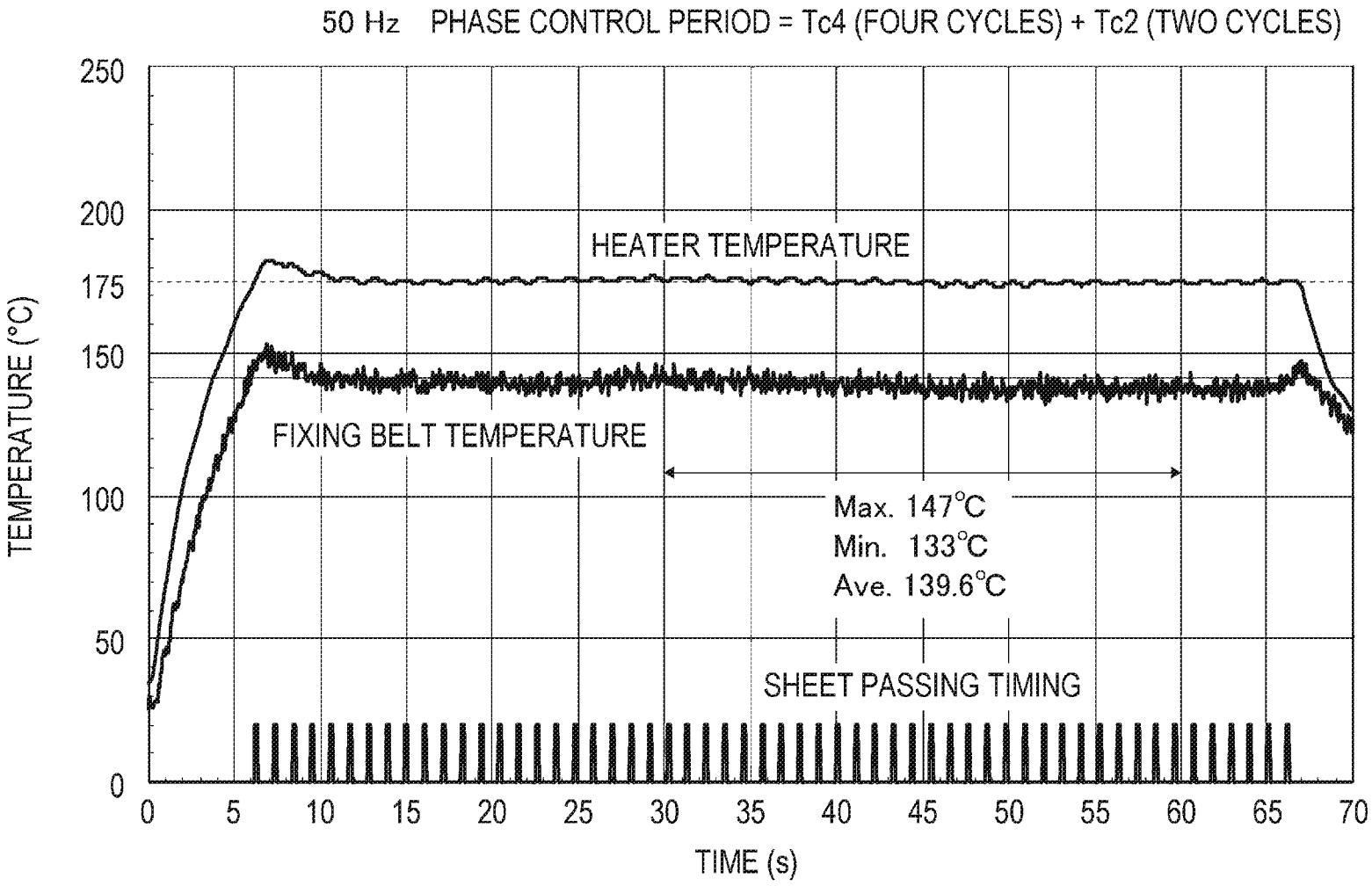
FIG. 10 is a diagram for describing temperature ripples of a ceramic heater and a fixing belt in phase control in which two phase control periods having different numbers of cycles are combined and to which the present exemplary embodiment is applied.

FIG. 10 is a diagram for describing temperature ripples of the ceramic heater 71 and the fixing belt 78 in the phase control using a combination of two phase control periods Tc4 and Tc2 having different numbers of cycles, to which the present exemplary embodiment is applied. Temperature ripples indicate fine changes in temperature. FIG. 10 illustrates the temperature (heater temperature) of the ceramic heater 71, the temperature (fixing belt temperature) of the fixing belt 78, and timings (sheet passing timings) at which sheets P are made pass. The horizontal axis indicates the time (second (s)) from a timing (time "0") at which the relay 733 of the power supply circuit 73 is switched on. The alternating-current power supply 5 is 50 Hz.

As illustrated in FIG. 10, the target of the temperature (heater temperature) of a part of the ceramic heater 71, which is passed by a sheet P, is set to 175° C. Between 30 s and 60 s after a timing at which the relay 733 is switched on, the fixing belt temperature reaches the maximum temperature (Max.) of 147° C., the minimum temperature (Min.) of 133° C., and the average temperature (Ave.) of 139.6° C.

Figure 11:
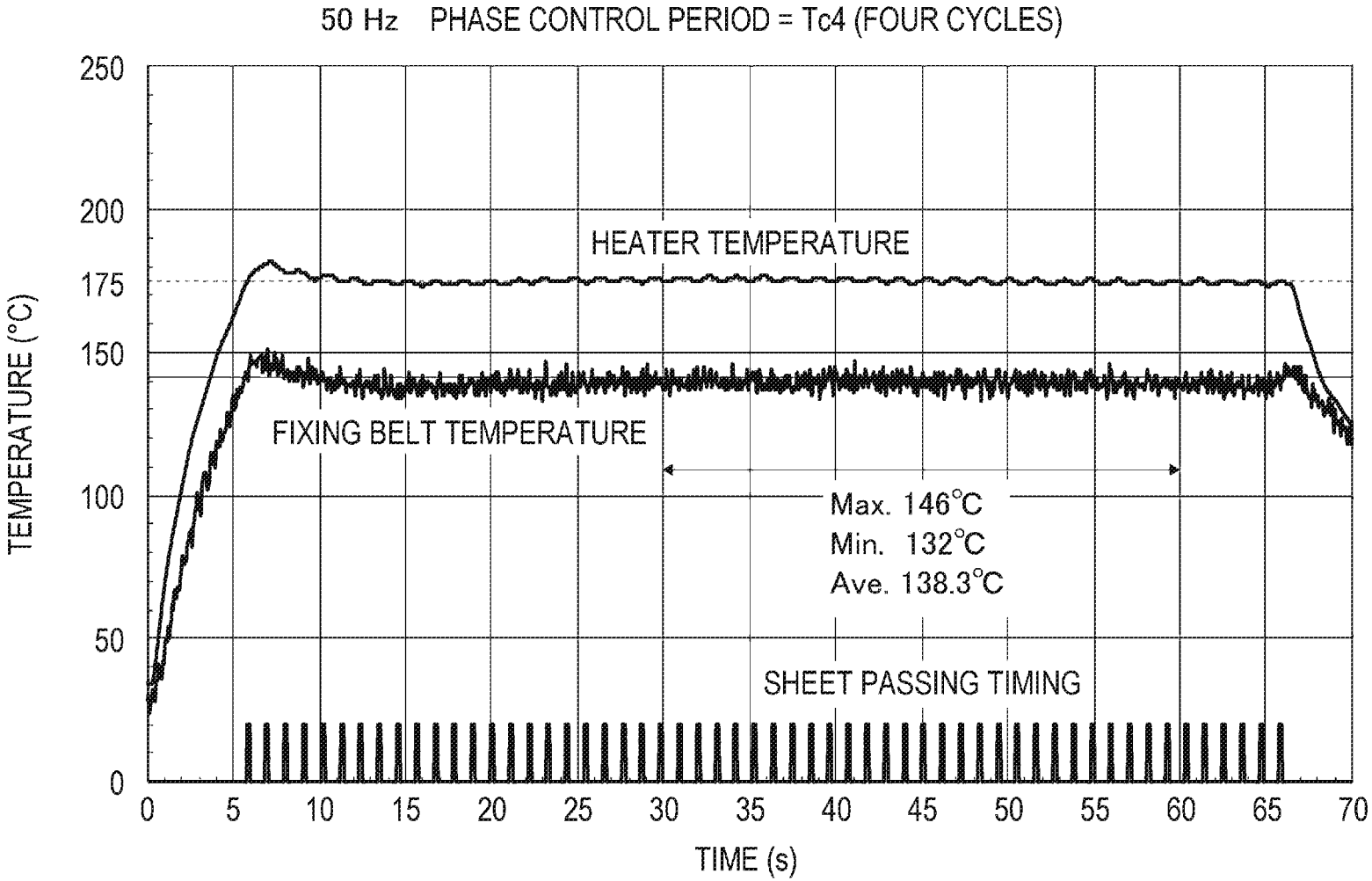
FIG. 11 RELATED ART
FIG. 11 is a diagram for describing temperature ripples of a ceramic heater and a fixing belt in phase control using a single phase control period, to which the present exemplary embodiment is not applied.

FIG. 11 is a diagram for describing temperature ripples of the ceramic heater 71 and the fixing belt 78 in the phase control using a phase control period Tc4, to which the present exemplary embodiment is not applied. Similar to FIG. 10, FIG. 11 also indicates the temperature (heater temperature) of the ceramic heater 71, the temperature (fixing belt temperature) of the fixing belt 78, and timings (sheet passing timings) at which sheets are made pass. The horizontal axis indicates the time (second (s)) from a timing (time "0") at which the relay 733 of the power supply circuit 73 is switched on in FIG. 3. The alternating-current power supply 5 is 50 Hz.

As illustrated in FIG. 11, the target of the temperature (heater temperature) of a part of the ceramic heater 71, which is passed by a sheet P, is set to 175° C. Between 30 s and 60 s after a timing at which the relay 733 is switched on, the fixing belt temperature reaches the maximum temperature (Max.) of 146° C., the minimum temperature (Min.) of 132° C., and the average temperature (Ave.) of 138.3° C.

As described above, there is not much difference between the phase control using the combination of four-cycle phase control periods Tc4 and two-cycle phase control periods Tc2 illustrated in FIG. 10 and the phase control using four-cycle phase control periods Tc4 illustrated in FIG. 11. That is, like the phase control using four-cycle phase control periods Tc4, the phase control using the combination of four-cycle phase control periods Tc4 and two-cycle phase control periods Tc2 may be applied to temperature control on the fixing belt 78. In the case where the alternating-current power supply 5 is 50 Hz, the harmonic wave noise (harmonic wave current (%)) does not exceed the threshold defined in the harmonic wave standard. Thus, in FIGS. 10 and 11, the comparison is made under the assumption that the alternating-current power supply 5 is 50 Hz.

As described above, the phase control using the combination of four-cycle phase control periods Tc4 and two-cycle phase control periods Tc2 may suppress the harmonic wave noise (harmonic wave current) when the phase control is applied to the case in which the alternating-current power supply 5 is 60 Hz.

In the embodiment above, the term "processor" refers to hardware in a broad sense. Examples of the processor include general processors (e.g., CPU: Central Processing Unit), dedicated processors (e.g., GPU: Graphics Processing Unit, ASIC: Application Specific Integrated Circuit, FPGA: Field Programmable Gate Array, and programmable logic device).

In the embodiment above, the term "processor" is broad enough to encompass one processor or plural processors in collaboration which are located physically apart from each other but may work cooperatively. The order of operations of the processor is not limited to one described in the embodiment above, and may be changed.

In the present disclosure, the description is made by taking the electrophotographic image forming apparatus as an example. However, this is not limited to an electrophotographic image forming apparatus. For example, the present disclosure may be applied to an ink-jet image forming apparatus or the like in which a sheet, which has been transported and which holds an un-dry ink image (unfixed ink image), comes in contact so that the unfixed ink image is fixed onto the sheet.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a fixing member that is used in fixing on recording material;

a heating element that is used to heat the fixing member;

a power supply circuit that causes current in phase control to flow to the heating element; and a processor configured to set a phase of the current by using a combination of a plurality of phase control periods in a Discrete Fourier Transformation (DFT) time window having different numbers of cycles supplied from an alternating-current power supply, the current flowing to the heating element, wherein the DFT time window is an integer multiple of the combination of the plurality of phase control periods.

2. The fixing device according to claim 1,
wherein the plurality of phase control periods have an identical on-duty.

3. The fixing device according to claim 2,
wherein the plurality of phase control periods have the on-duty having vertical symmetry between a positive half wave and a negative half wave.

4. The fixing device according to claim 1,
wherein each of the plurality of phase control periods has an even number of cycles.

5. The fixing device according to claim 4,
wherein each of the plurality of phase control periods has four cycles or two cycles.

6. The fixing device according to claim 5,
wherein a frequency of the alternating-current power supply is 60 Hz.

7. The fixing device according to claim 6,
wherein the plurality of phase control periods are used in ranges of a duty of power supplied, the ranges including a range between 15% and 35% inclusive and a range between 65% and 85% inclusive.

8. An image forming apparatus comprising:
an unfixed-image forming device that forms an unfixed image on recording material; and
the fixing device according to claim 1.

* * * * *